United States Patent [19]

Mueller

[11] Patent Number: 4,564,345

[45] Date of Patent: Jan. 14, 1986

[54] SUPERCHARGER WITH REDUCED NOISE

[75] Inventor: Robert S. Mueller, Birmingham, Mich.

[73] Assignee: Eaton Corporation, Cleveland, Ohio

[21] Appl. No.: 647,072

[22] Filed: Sep. 4, 1984

[51] Int. Cl.[4] ..... F01C 1/24

[52] U.S. Cl. ..... 418/206

[58] Field of Search ..... 418/201-206

[56] References Cited

U.S. PATENT DOCUMENTS

| | | | |
|---|---|---|---|
| 1,746,885 | 2/1930 | Bunge et al. | 418/206 |
| 2,014,932 | 9/1935 | Hallett | 418/83 |
| 2,028,414 | 1/1936 | Schneider | 418/200 |
| 2,078,334 | 4/1937 | Martocello | 418/203 |
| 2,259,027 | 10/1941 | De Zarate et al. | 418/206 |
| 2,448,901 | 8/1943 | McCulloch et al. | 418/206 |
| 2,454,048 | 11/1948 | Flanagan | 418/206 |
| 2,463,080 | 2/1945 | Beier | 418/206 |
| 2,480,818 | 8/1949 | Whitfield | 103/128 |
| 2,906,448 | 9/1959 | Lorenz | 418/85 |
| 3,058,652 | 10/1962 | Glamann | 418/206 |
| 3,121,529 | 2/1964 | Hubrich | 418/203 |
| 3,531,227 | 9/1970 | Weatherston | 418/94 |
| 3,667,874 | 6/1972 | Weatherston et al. | 418/9 |
| 3,844,695 | 10/1974 | Weatherston | 418/180 |
| 4,042,062 | 8/1977 | Tooley | 181/36 |
| 4,135,602 | 1/1979 | Clark | 181/230 |
| 4,210,410 | 7/1980 | Ohtani | 418/150 |
| 4,215,977 | 8/1980 | Weatherston | 418/1 |

*Primary Examiner*—Leonard E. Smith
*Assistant Examiner*—Jane E. Obee
*Attorney, Agent, or Firm*—C. H. Grace; P. S. Rulon

[57] ABSTRACT

An improved supercharger or blower (10) of the Roots-type with reduced airborne noise. The blower includes a housing (12) defining generally cylindrical chambers (32, 34) containing meshed lobed rotors (14, 16) having the lobes (14*a*, 14*b*, 14*c*, 16*a*, 16*b*, 16*c*) thereon formed with an end-to-end helical twist according to the relation 360°/2n, where n equals the number of lobes per rotor. Blower housing (12) also defines inlet and outlet ports (36, 38). The inlet port includes a longitudinal extent defined by housing wall surfaces (20*f*, 20*h*) and a transverse extent defined by housing wall surfaces 20*g*, 20*i*. Transverse wall surfaces (20*g*, 20*i*) are disposed substantially parallel to the associated rotor lobes. The outlet port includes a longitudinal extent defined by housing surfaces (20*m*, 20*r*) and a transverse extent defined by housing surfaces (20*p*, 20*s*). Spaces (32*a*, 34*a*) between adjacent lobes of each rotor transfer volumes of low-pressure inlet port air to relatively high-pressure outlet port air. Associated with the outlet port are first and second expanding orifices (42, 44) disposed on transversely opposite sides of the outlet port for controlling the rate of backflow into the transfer volumes and operative at predetermined rotor speed and pressure differential relationships to maintain a substantially constant backflow rate into each of the transfer volumes.

18 Claims, 8 Drawing Figures

Fig. 2.
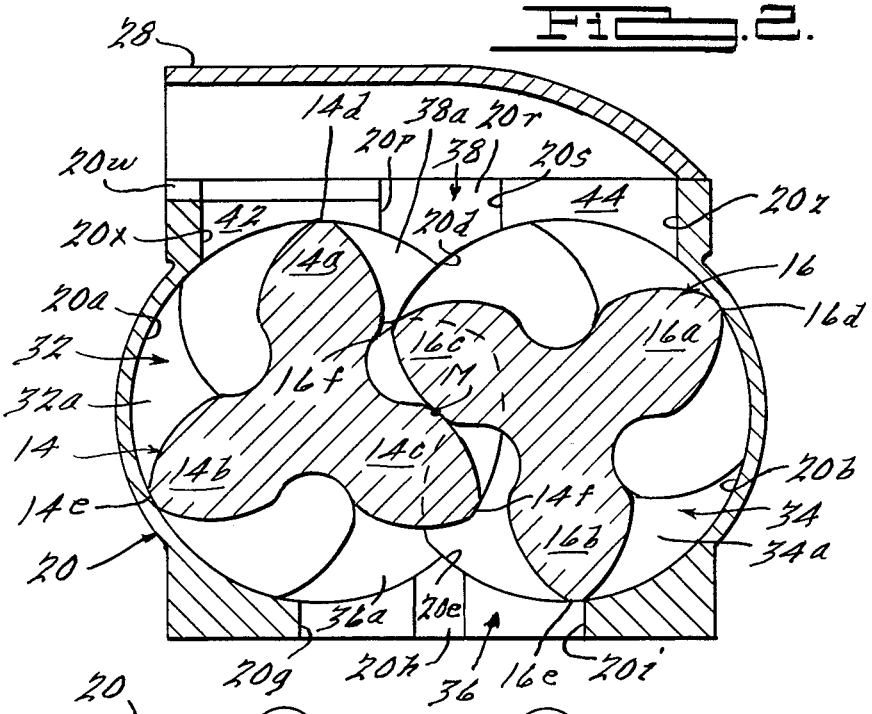
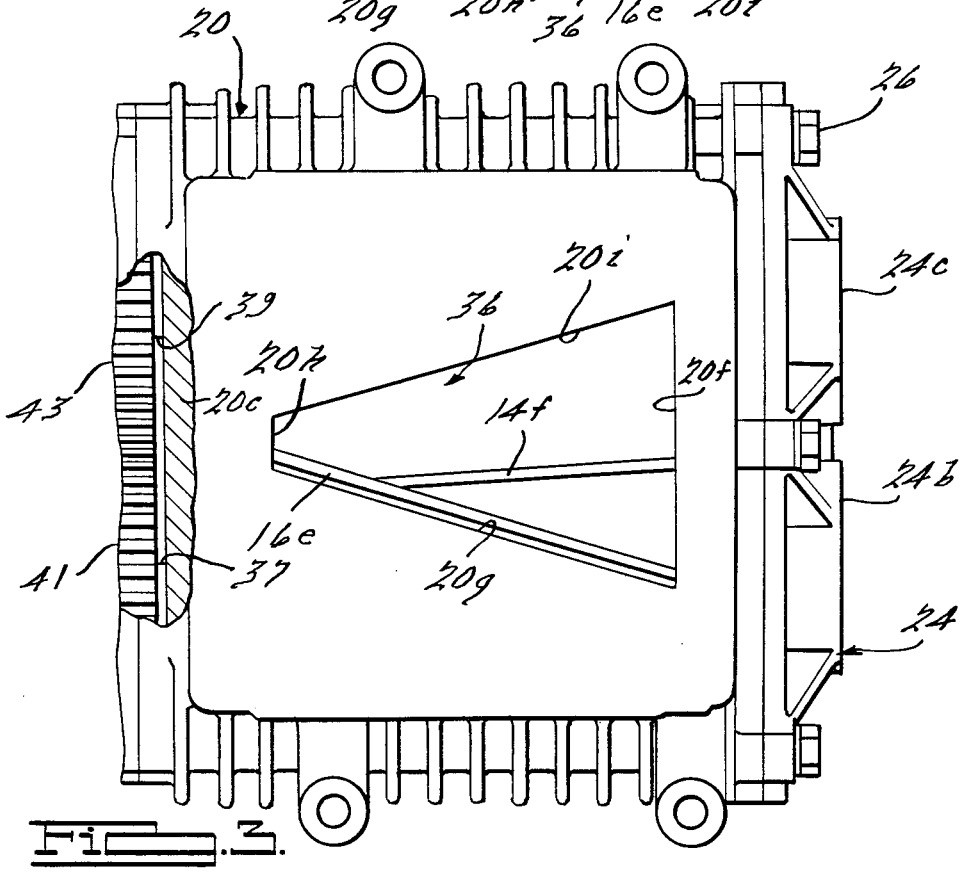
Fig. 3.

FIG. 6.
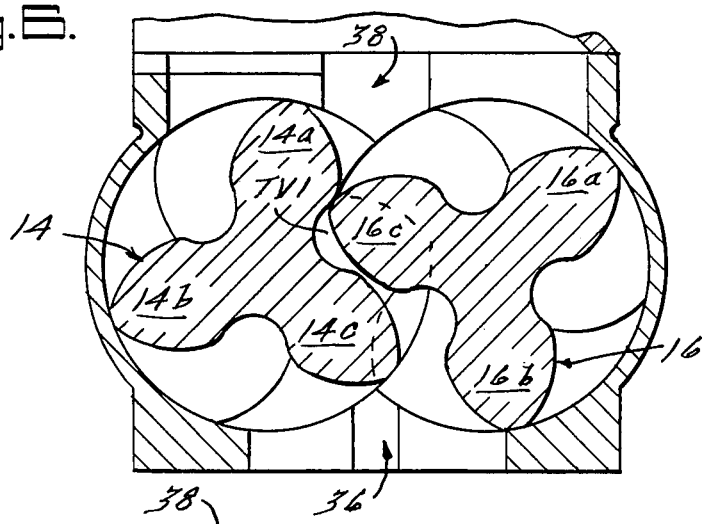
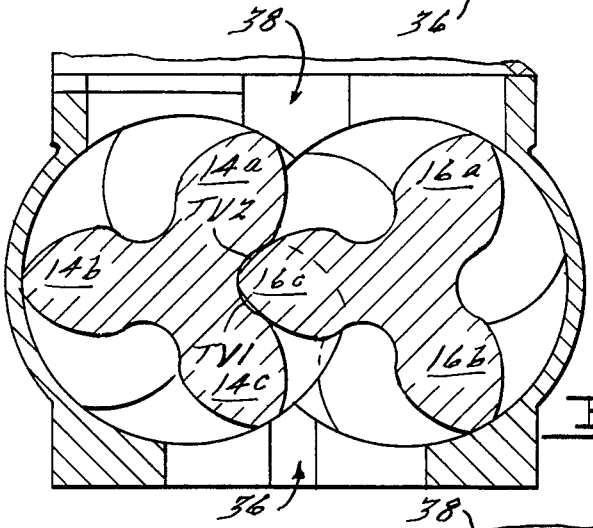
FIG. 7.
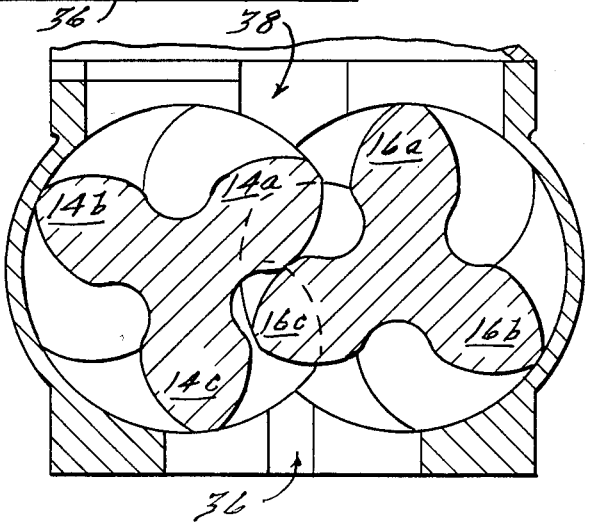
FIG. 8.

SUPERCHARGER WITH REDUCED NOISE

CROSS-REFERENCE TO RELATED APPLICATION

The invention of this application relates to U.S. application Ser. Nos. 647,071, 647,073, and 647,074, filed Sept. 4, 1985. These applications are assigned to the assignee of this application.

BACKGROUND OF THE INVENTION

Field of the Invention

This invention relates to rotary compressors or blowers, particularly to blowers of the backflow type. More specifically, the present invention relates to reducing airborne noise associated with Roots-type blowers employed as superchargers for internal combustion engines.

Description of the Prior Art

Rotary blowers particularly Roots-type blowers are characterized by noisy operation. The blower noise may be roughly classified into two groups: solid borne noise caused by rotation of timing gears and rotor shaft bearings subjected to fluctuating loads, and fluid borne noise caused by fluid flow characteristics such as rapid changes in fluid velocity. Fluctuating fluid flow contributes to both solid and fluid borne noise.

As is well-known, Roots-type blowers are similar to gear-type pumps in that both employ toothed or lobed rotors meshingly disposed in transversely overlapping cylindrical chambers. Top lands of the lobes sealingly cooperate with the inner surfaces of the cylindrical chambers to trap and transfer volumes of fluid between adjacent lobes on each rotor. Roots-type blowers are used almost exclusively to pump or transfer volumes of compressible fluids, such as air, from an inlet receiver chamber to an outlet receiver chamber. Normally, the inlet chamber continuously communicates with an inlet port and the outlet chamber continuously communicates with an outlet port. The inlet and outlet ports often have a transverse width nominally equal to the transverse distance between the axes of the rotors. Hence, the cylindrical wall surfaces on either side of the ports are nominally 180° in arc length. Each receiver chamber volume is defined by the inner boundary of the associated port, the meshing interface of the lobes, and sealing lines between the top lands of the lobes and cylindrical wall surfaces. The inlet receiver chamber expands and contracts between maximum and minimum volumes while the outlet receiver chamber contracts and expands between like minimum and maximum volumes. In most Roots-type blowers, transfer volumes are moved to the outlet receiver chamber without compression of the air therein by mechanical reduction of the transfer volume size. If outlet port air pressure is greater than the air pressure in the transfer volume, outlet port air rushes or backflows into the volumes as they become exposed to or merged into the outlet receiver chamber. Backflow continues until pressure equalization is reached. The amount of backflow air and rate of backflow are, of course, a function of pressure differential. Backflow into one transfer volume which ceases before backflow starts into the next transfer volume, or which varies in rate, is said to be cyclic and is a known major source of airborne noise.

Another major source of airborne noise is cyclic variations in volumetric displacement or nonuniform displacement of the blower. Nonuniform displacement is caused by cyclic variations in the rate of volume change of the receiver chamber due to meshing geometry of the lobes and due to trapped volumes between the meshing lobes. During each mesh of the lobes first and second trapped volumes are formed. The first trapped volumes contain outlet port or receiver chamber air which is abruptly removed from the outlet receiver chamber as the lobes move into mesh and abruptly returned or carried back to the inlet receiver chamber as the lobes move out of mesh. As the differential pressure between the receiver chambers increases, so does the mass of carry-over air to the inlet receiver chamber with corresponding increases in the rate of volume change in the receiver chambers and corresponding increases in airborne noise. Further, blower efficiency decreases as the mass of carry-over air increases.

The trapped volumes are further sources of airborne noise and inefficiency for both straight and helical lobed rotors. With straight lobed rotors, both the first and second trapped volumes are formed along the entire length of the lobes, whereas with helical lobes rotors, the trapped volumes are formed along only a portion of the length of the lobes with a resulting decrease in the degrading effects on noise and efficiency. The first trapped volumes contain outlet port air and decrease in size from a maximum to a minimum, with a resulting compressing of the fluid therein. The second trapped volumes are substantially void of fluid and increase in size from a minimum to a maximum with a resulting vacuum tending expansion of fluid therein. The resulting compression of air in the first trapped volumes, which are subsequently expanded back into the inlet port, and expansion of the second trapped volumes are sources of airborne noise and inefficiencies.

Many prior art patents have addressed the problems of airborne noise. For example, it has long been known that nonuniform displacement, due to meshing geometry, is greater when rotor lobes are straight or parallel to the rotor axes and that substantially uniform displacement is provided when the rotor lobes are helically twisted. U.S. Pat. No. 2,014,932 to Hallett teaches substantially uniform displacement with a Roots-type blower having two rotors and three 60° helical twist lobes per rotor. Theoretically, such helical lobes could or would provide uniform displacement were it not for cyclic backflow and trapped volumes. Nonuniform displacement, due to trapped volumes, is of little or no concern with respect to the Hallett blower since the lobe profiles therein inherently minimize the size of the trapped volumes. However, such lobe profiles, in combination with the the helical twist, can be difficult to accurately manufacture and accurately time with respect to each other when the blowers are assembled.

Hallett also addressed the backflow problem and proposed reducing the initial rate of backflow to reduce the instantaneous magnitude of the backflow pulses. This was done by a mismatched or rectangular shaped outlet port having two sides parallel to the rotor axes and, therefore, skewed relative to the traversing top lands of the helical lobes. U.S. Pat. No. 2,463,080 to Beier discloses a related backflow solution for a straight lobe blower by employing a triangular outlet port having two sides skewed relative to the rotor axes and, therefore, mismatched relative to the traversing lands of the straight lobes. The arrangement of Hallett and Beier slowed the initial rate of backflow into the transfer volume and therefore reduced the instantaneous magnitude of the backflow. However, neither teaches nor suggests controlling the rate of backflow so as to obtain a continuous and constant rate of backflow.

Several other prior art U.S. Patents have also addressed the backflow problem by preflowing outlet port or receiver chamber air into the transfer volumes before the lands of the leading lobe of each transfer volume traverses the outer boundary of the outlet port. In some of these patents, preflow is provided by passages of fixed flow area through the cylindrical walls of the housing sealing cooperating with the top lands of the rotor lobes. Since the passages are of fixed flow area, the rate of preflow decreases with decreasing differential pressure. Hence, the rate of preflow is not constant.

U.S. Pat. No. 4,215,977 to Weatherston discloses preflow and purports to provide a Roots-type blower having uniform displacement. However, the lobes of Weatherston are straight and, therefore, believed incapable of providing uniform displacement due to meshing geometry.

The Weatherston blower provides preflow of outlet receiver chamber air to the transfer volumes via circumferentially disposed, arcuate channels or slots formed in the inner surfaces of the cylindrical walls which sealingly cooperate with the top lands of the rotor lobes. The top lands and channels cooperate to define orifices for directing outlet receiver chamber air into the transfer volumes. The arc or setback length of the channels determines the beginning of preflow. Weatherston suggests the use of additional channels of lesser setback length to hold the rate of preflow relatively constant as pressure in the transfer volumes increases. The Weatherston preflow arrangement, which is analogous to backflow, is believed theoretically capable of providing a relatively constant preflow rate for predetermined blower speeds and differential pressures. However, to obtain relatively constant preflow, several channels of different setback length would be necessary. Further, accurate and consistent forming of the several channels on the interior surface of the cylindrical walls is, at best, an added manufacturing cost.

SUMMARY OF THE INVENTION

An object of the present invention is to provide a rotary blower of the backflow type for compressible fluids which is relatively free of airborne noises due to nonuniform displacement.

Another object of the present invention is to provide a rotary blower of the backflow type for compressible fluids wherein backflow is relatively constant when the blower operates at predetermined speeds and differential pressures.

Another object of the present invention is to provide a rotary blower of the backflow type for compressible fluids wherein nonuniform displacement, due to meshing geometry and trapped volumes, is substantially eliminated.

According to an important feature of the present invention, a rotary blower of the backflow type includes a housing defining inlet and outlet ports and a chamber containing first and second meshed lobed rotors for transferring volumes of relatively low-pressure inlet port fluid, via spaces between adjacent, unmeshed lobes, to relatively high-pressure outlet port fluid, which alternately backflows into each volume in response to alternate and initial traversing of wall surfaces, defining transversely opposite boundaries of the outlet port. The improvement comprises first and second expanding orifices, for controlling the backflow rate, the orifices being defined by transverse extensions of the wall surfaces defining the opposite transverse boundaries of the outlet port and transversing of the extended wall surfaces by the lobes, and the orifices being operative at predetermined rotor speeds and pressure differential relationships to maintain a substantially constant backflow rate.

BRIEF DESCRIPTION OF THE DRAWINGS

A Roots-type blower intended for use as a supercharger is illustrated in the accompanying drawings in which:

FIG. 2 is a schematic sectional view of the blower looking along line 2—2 of FIG. 1;

FIG. 3 is a partially broken away bottom view of a portion of the blower looking in the direction of arrow 3 in FIG. 1;

FIGS. 6, 7 and 8 are reduced views of the blower section of FIG. 2 with the meshing relationships of the rotors therein varied.

DETAILED DESCRIPTION OF THE DRAWINGS

Figure 1:
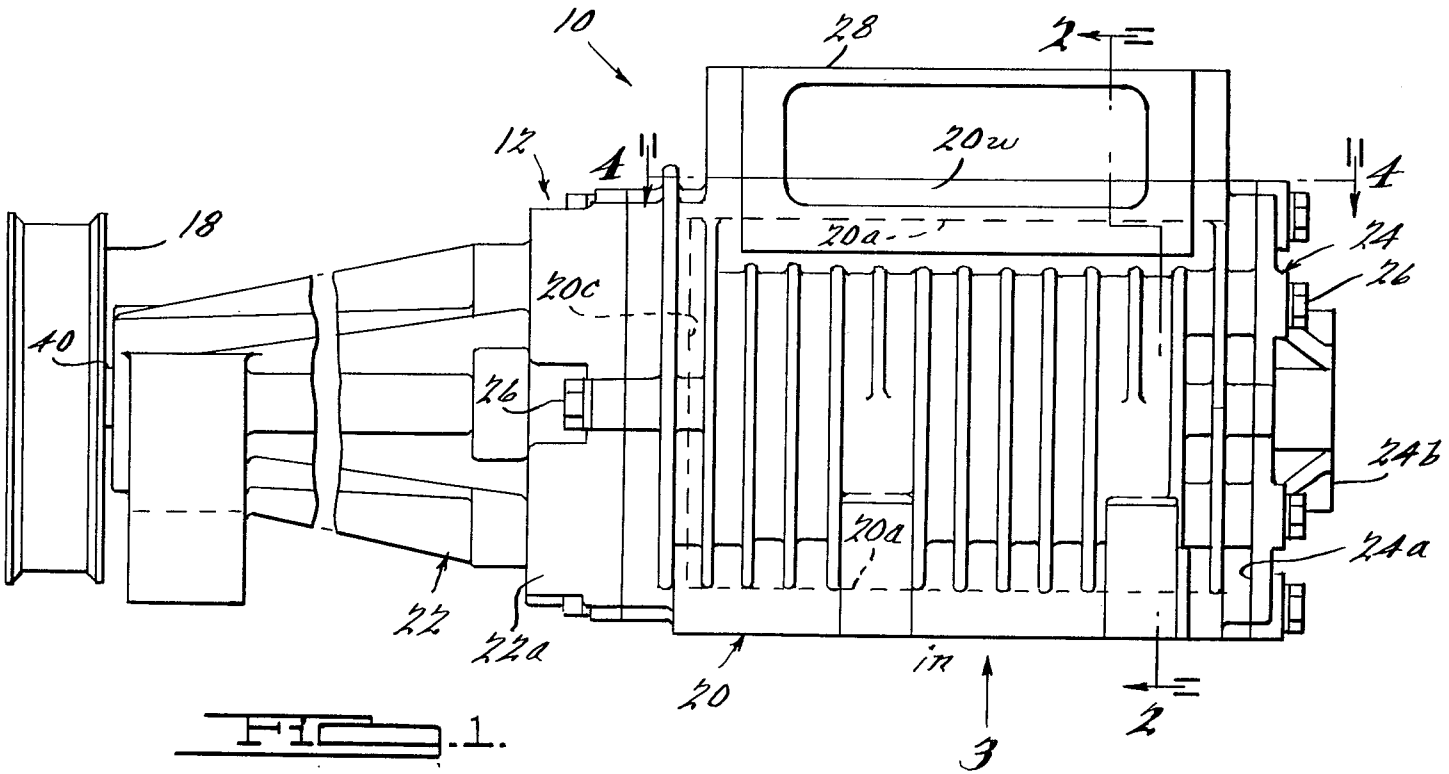
FIG. 1 is a side elevational view of the Roots-type blower.

FIGS. 1–4 illustrate a rotary pump or blower 10 of the Roots-type. As previously mentioned, such blowers are used almost exclusively to pump or transfer volumes of compressible fluid, such as air, from an inlet port to an outlet port without compressing the transfer volumes prior to exposure to the outlet port. The rotors operate somewhat like gear-type pumps, i.e., as the rotor teeth or lobes move out of mesh, air flows into volumes or spaces defined by adjacent lobes on each rotor. The air in the volumes is then trapped therein at substantially inlet pressure when the top lands of the trailing lobe of each transfer volume moves into a sealing relation with the cylindrical wall surfaces of the associated chamber. The volumes of air are transferred or exposed to outlet air when the top land of the leading lobe of each volume moves out of sealing relation with the cylindrical wall surfaces by traversing the boundary of the outlet port. If the volume of the transfer volumes remains constant during the trip from inlet to outlet, the air therein remains at inlet pressure, i.e., transfer volume air pressure remains constant if the top lands of the leading lobes traverse the outlet port boundary before the volumes are squeezed by virtue of remeshing of the lobes. Hence, if air pressure at the discharge port is greater than inlet port pressure, outlet port air rushes or backflows into the transfer volumes as the top lands of the leading lobes traverse the outlet port boundary.

Blower 10 includes a housing assembly 12, a pair of lobed rotors 14, 16, and an input drive pulley 18. Housing assembly 12, as viewed in FIG. 1, includes a center section 20, left and right end sections 22, 24 secured to opposite ends of the center section by a plurality of bolts 26, and an outlet duct member 28 secured to the center section by a plurality of unshown bolts. The housing assembly and rotors are preferably formed from a lightweight material such as aluminum. The center section and end 24 define a pair of generally cylindrical working chambers 32, 34 circumferentially defined by cylindrical wall portions or surfaces 20*a*, 20*b*, an end wall surface indicated by phantom line 20*c* in FIG. 1, and an end wall surface 24*a*. Chambers 32, 34 traversely overlap or intersect at cusps 20*d*, 20*e*, as seen in FIG. 2. Openings 36, 38 in the bottom and top of center section 20 respectively define the transverse and longitudinal boundaries of inlet and outlet ports.

Rotors 14, 16 respectively include three circumferentially spaced apart helical teeth or lobes 14*a*, 14*b*, 14*c* and 16*a*, 16*b*, 16*c* of modified involute profile with an end-to-end twist of 60° . The lobes or teeth mesh and preferably do not touch. A sealing interface between meshing lobes 14*c*, 16*c* is represented by point M in FIG. 2. Interface or point M moves along the lobe profiles as the lobes progress through each mesh cycle and may be defined in several places as shown in FIG. 7. The lobes also include top lands 14*d*, 14*e*, 14*f*, and 16*d*, 16*e*, 16*f*. The lands move in close sealing noncontacting relation with cylindrical wall surfaces 20*a*, 20*b* and with the root portions of the lobes they are in mesh with. Rotors 14, 16 are respectively mounted for rotation in cylindrical chambers 32, 34 about axes coincident with the longitudinally extending, transversely spaced apart, parallel axes of the cylindrical chambers. Such mountings are well-known in the art. Hence, with respect to FIG. 3, it should suffice to say that shafts 37,39 extending from and fixed to the rotors are supported by unshown bearings carried by end wall 20*c* and end section 24. Bearings for carrying the shaft ends extending rightwardly into end section 24 are carried by outwardly projecting bosses 24*b*, 24*c*. The rotors may be mounted and timed as shown in U.S. Pat. Application Ser. No. 506,075, filed June 20, 1983 and incorporated herein by reference. Rotor 16 is directly driven by pulley 18 which is fixed to the left end of a shaft 40. Shaft 40 is either connected to or an extension of shaft 37 extending from the left end of rotor 16. Rotor 14 is driven in a conventional manner by timing gears 41,43 fixed to the shaft ends extending from the left ends of the rotors. The timing gears are of the substantially no backlash type and are disposed in a chamber defined by a portion 22*a* of end section 22.

The rotors, as previously mentioned, have three circumferentially spaced lobes of modified involute profile with an end-to-end helical twist of 60° . Rotors with other than three lobes, with different profiles and with different twist angles, may be used to practice certain aspects or features of the inventions disclosed herein. However, to obtain uniform displacement based on meshing geometry and trapped volumes, the lobes are preferably provided with a helical twist from end-to-end which is substantially equal to the relation 360°/2n, where n equals the number of lobes per rotor. Further, involute profiles are also preferred since such profiles are more readily and accurately formed than most other profiles; this is particularly true for helically twisted lobes. Still further, involute profiles are preferred since they have been more readily and accurately timed during supercharger assembly.

As may be seen in FIG. 2, the rotor lobes and cylindrical wall surfaces sealingly cooperate to define an inlet receiver chamber 36*a*, an outlet receiver chamber 38*a*, and transfer volumes 32*a*, 34*a*. For the rotor positions of FIG. 2, inlet receiver chamber 36*a* is defined by portions of the cylindrical wall surfaces disposed between top lands 14*e*, 16*e* and the lobe surfaces extending from the top lands to the interface M of meshing lobes 14*c*, 16*c*. Interface M defines the point or points of closest contact between the meshing lobes. Likewise, outlet receiver chamber 38*a* is defined by portions of the cylindrical wall surfaces disposed between top lands 14*d*, 16*d* and the lobe surfaces extending from the top lands to the interface M of meshing lobes 14*c*, 16*c*. During each meshing cycle and as previously mentioned, meshing interface M moves along the lobe profile and is often defined at several places such as illustrated in FIGS. 6 and 7. The cylindrical wall surfaces defining both the inlet and outlet receiver chambers include those surface portions which were removed to define the inlet and outlet ports. Transfer volume 32*a* is defined by adjacent lobes 14*a*, 14*b* and the portion of cylindrical wall surfaces 20*a* disposed between top lands 14*d*, 14*e*. Likewise, transfer volume 34*a* is defined by adjacent lobes 16*a*, 16*b* and the portion of cylindrical wall surface 20*b* disposed between top lands 16*d*, 16*e*. As the rotors turn, transfer volumes 32*a*, 34*a* are reformed between subsequent pairs of adjacent lobes.

Figure 4:
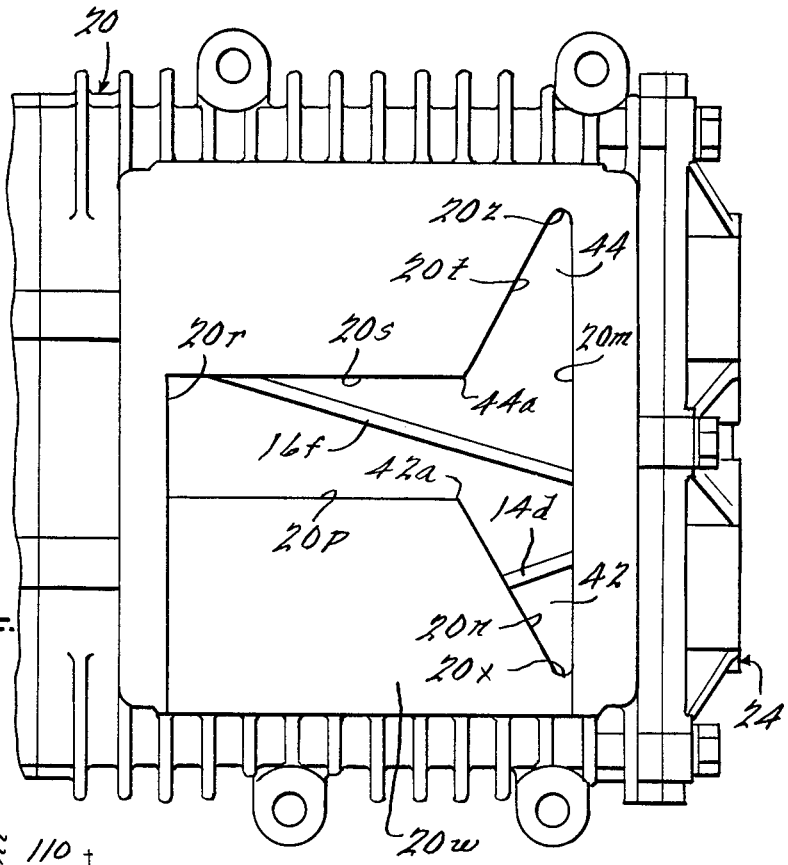
FIG. 4 is a top view of a portion of the blower looking along line 4—4 of FIG. 1.

Inlet port 36 is provided with an opening shaped substantially like an isosceles trapezoid by wall surfaces 20*f*, 20*g*, 20*h*, 20*i* defined by housing section 20. Wall surfaces 20*f*, 20*h* define the longitudinal extent of the port and wall surfaces 20*g*, 20*i* define the transverse boundaries or extent of the port. The isosceles sides or wall surfaces 20*g*, 20*i* are matched or substantially parallel to the traversing top lands of the lobes. The top lands of the helically twisted lobes in both FIGS. 3 and 4 are schematically illustrated as being straight for simplicity herein. As viewed in FIGS. 3 and 4, such lands actually have a curvature. Wall surfaces 20*g*, 20*i* may be curved to more closely conform to the helical twist of the top lands.

Outlet port 38 is provided with a somewhat T-shaped opening by wall surfaces 20*m*, 20*n*, 20*p*, 20*r*, 20*s*, 20*t* defined by housing section 20. The top surface of housing 20 includes a recess 20*w* to provide an increased flow area for outlet duct 28. Wall surfaces 20*m*, 20*r* are parallel and define the longitudinal extent of the port. Wall surfaces 20*p*, 20*s* and their projections to surface 20*m* define the transverse boundaries or extent of the port for outflow of most air from the blower. Wall surfaces 20*p*, 20*s* are also parallel and may be spaced farther apart than shown herein if additional outlet port area is needed to prevent a pressure drop or back pressure across the outlet port. Diagonal or transverse wall surfaces 20*n*, 20*t*, which converge with transverse extensions of wall surface 20*m* at apexes 20*x*, 20*z*, define expanding orifices 42, 44 in combination with the traversing top lands of the lobes. The expanding orifices control the rate of back flow air into the transfer volumes. Expanding orifice 42 extends from apex 20*x*, i.e., the convergence of wall extensions 20*m*,20*n*, to intersection 42*a* of outlet port wall surface 20*p* and transverse wall surface 20*n*. Likewise, expanding orifice 44 extends from apex 20*z*, i.e., the convergence of wall extensions 20*m*, 20*t*, to intersection 44*a* of outlet port wall surface 20*s* and transverse wall surface 20*t* Orifices 42, 44 are designed to expand at a rate operative to maintain a substantially constant backflow rate of air into the transfer volumes when the blower operates at predetermined speed and differential pressure relationships i.e., the intersection 42*a*,44*a* of the outlet port wall surfaces 20*p*,20*s* and the transverse wall extensions 20*m*,20*n*,20*t* defining each expanding orifice 20*x*,20*z* are spaced apart such that a lobe of one rotor traverses the intersection 42*a* or 44*a* of one of the expanding orifices 42,44 at substantially the same time a lobe of the other rotor transverses the convergence or apex 20*z*,20*x* of the transverse wall extensions of the other expanding orifice. Apexes 20*x*, 20*z* are respectively spaced approximately 60 rotational degrees from intersections 42*a*, 44*a*. The expanding orifices are alternately traversed by the top lands of the associated lobes. Accordingly, the orifices 42,44 expand over a period of substantially 60 rotational degrees of the rotors or 360°/2n, where, as previously mentioned, n equals the number of lobes per rotor. The spacing between inlet port wall surfaces 20*g*, 20*i* and the apexes allows the top lands of the trailing lobes of each transfer volume to move into sealing relation with the cylindrical wall surfaces before backflow starts and allows a full 60° rotation of the lobes, for backflow. Apexes 20*x*, 20*z* may be positioned to allow backflow slightly before the top lands of the trailing lobes of each transfer volume move into sealing relation with cylindrical wall surfaces 20*a*, 20*b*, thereby providing a slight overlap between the beginning and ending of backflow to ensure a smoother and continuous transition of backflow from one transfer volume to the the next.

Figure 5:
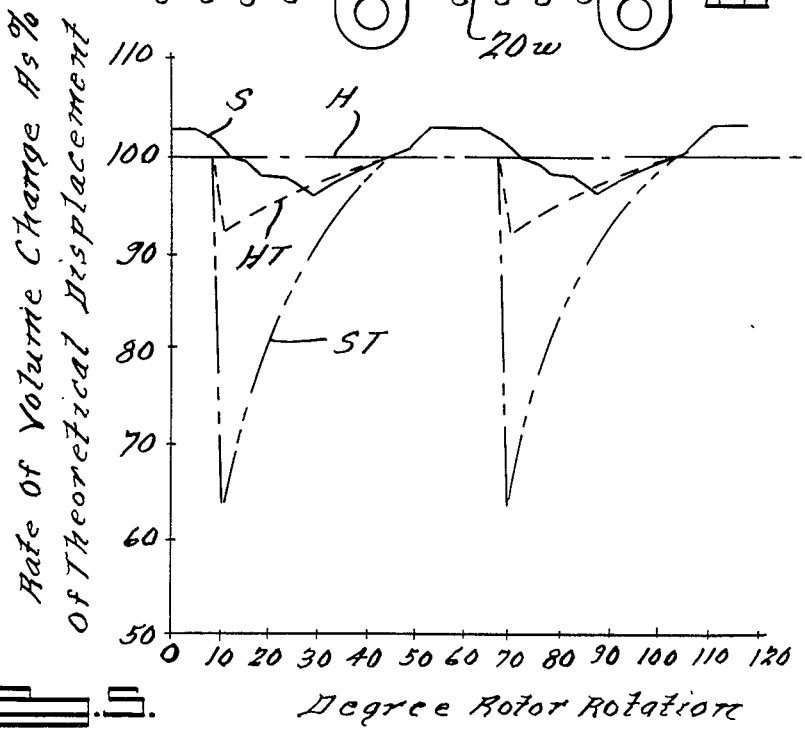
FIG. 5 is a graph illustrating operational characteristics of the blower.

Looking now for a moment at the graph of FIG. 5, therein curves S and H illustrate cyclic variations in volumetric displacement over 60° periods of rotor rotation. The variations are illustrated herein in terms of degrees of rotation but may be illustrated in terms of time. Such cyclic variations are due to the meshing geometry of the rotor lobes which effect the rate of change of volume of the outlet receiver chamber 38*a*. Since the inlet and outlet receiver chamber volumes vary at substantially the same rate and merely inverse to each other, the curves for outlet receiver chamber 38*a* should suffice to illustrate the rate of volume change for both chambers. Curve S illustrates the rate of change for a blower having three straight lobes of modified involute profile per rotor and curve H for a blower having three 60° helical twist lobes of modified involute profile per rotor. As may be seen, the absolute value of rate-of-change is approximately 7% of theoretical displacement for straight lobe rotors while there is no variation in the rate of displacement for 60° helical lobes.

The rate of volume change or uniform displacement for both straight and helical lobes, as previously mentioned, is due in part to the meshing geometry of the lobes. For straight lobes, the meshing relationship of the lobes is the same along the entire length of the lobes, i.e., the meshing relationship at any cross section or incremental volume along the meshing lobes is the same. For example, interface or point M of FIG. 2 is the same along the entire length of the meshing lobes, and a line through the points is straight and parallel to the rotor axis. Hence, a rate of volume change, due to meshing geometry, is the same and additive for all incremental volumes along the entire length of the meshing lobes. This is not the case for helical lobes formed according to the relation 360°/2n. For three lobe rotors having 60° helical lobes, the meshing relationship varies along the entire length of the meshing lobes over a 60° period. For example, if the meshing lobes were divided into 60 incremental volumes along their length, 60 different meshing relationships would exist at any given time, and a specific meshing relationship, such as illustrated in FIG. 2, would first occur at one end of the meshing lobes and then be sequentially repeated for each incremental volume as the rotors turn through 60 rotational degrees. If the meshing relationship of an incremental volume at one end of meshing lobes tends to increase the rate of volume change, the meshing relationship of the incremental volume at the other end of the meshing lobes tends to decrease the rate of volume change an equal amount. This additive-substractive or canceling relationship exists along the entire length of the meshing lobes and thereby cancels rates of volume change or provides uniform displacement with respect to meshing geometry.

Volumes of fluid trapped between meshing lobes are another cause or source affecting the rate of cyclic volume change of the receiver chambers. The trapped volumes are abruptly removed from the outlet receiver chamber and abruptly returned or carried back to the inlet receiver chamber. The trapped volumes also reduce blower displacement and pumping efficiency. Curves ST and HT in the graph of FIG. 5 respectively illustrate the rate of cyclic volume change of the outlet receiver chamber due to trapped volumes for straight and 60° helical twist lobes. As may be seen, the rate of volume change, as a percentage of theoretical displacement due to trapped volumes is approximately 4.5 times greater for straight lobes. The total rate of volume change of the receiver chamber is obtained by adding the associated curves for meshing geometry and trapped volume together.

Looking briefly at the rightward end of the rotors, as illustrated in FIGS. 6 and 7, therein is shown areas trapped between adjacent lobes 14*a*, 14*c* and 16*c*. The areas may be thought of as incremental volumes when they have a small depth. The area for the meshing relationship of FIG. 6 represents a maximum incremental volume $TV_1$. With reference to FIG. 7, as the rotors turn, incremental volume $TV_1$, decreases in size while a second incremental volume $TV_2$ is formed which increases in size.

For straight lobe rotors, each maximum incremental volume $TV_1$ is formed along the entire length of the meshing lobes at substantially the same instant. Likewise, each incrememental volume $TV_2$ is formed along the entire length of the meshing lobes at substantially the same instant. Hence, the individual sums $\Sigma TV_1$ and $\Sigma TV_2$ of the incremental volumes define or form trapped volumes. $\Sigma TV_1$ and $\Sigma TV_2$ contribute to airborne noise and reduced blower efficiency. Both, particularly $\Sigma TV_1$, cause substantial rates of volume change as illustrated in the graph of FIG. 5. The carryback of fluid in $\Sigma TV_1$ and the respective decrease and increase in the size of $\Sigma TV_1$ and $\Sigma TV_2$ directly reduce blower efficiency.

Helical lobes greatly reduce the size of $TV_1$ and $TV_2$; this may be illustrated with reference to FIG. 6, which is an end view of the rightward end of the rotors. With helical lobes, incremental volume $TV_1$ at the rightward end of meshing lobes 14*a*, 14*c* and 16*c* is not trapped and subsequent incremental volumes $TV_1$ from right-to-left are not trapped until the leftward end of lobes 14*a*, 14*c* and 16*c* move into the same meshing relationship. For 60° twist lobes this does not occur until the rotors turn an additional 60°. During this 60° period, each successive incremental volume $TV_1$ from right-to-left decreases in size while still in communication with the outlet receiver chamber. Hence, the number of trapped incremental volumes $TV_1$ is greatly reduced. Further, the total volume of this number of trapped incremental volumes is less than the total volume of a comparable number of straight lobe incremental volumes since trapped incremental volumes with helical lobes vary in cross-sectional area from a minimum to a maximum. The number of trapped incremental volumes $TV_2$ and their total volume is the same as described for incremental volumes $TV_1$. However, their formation sequence occurs in the reverse order, i.e., when incremental volume $TV_2$ starts to form and expand at the right end of the lobes, it and subsequent incremental volumes $TV_2$ are trapped until the right end of the lobes moves to the meshing relationship shown in FIG. 8; from thereon all incremental volumes $TV_2$ are in constant communication with the inlet receiver chamber.

The preferred embodiment of the invention has been disclosed in detail for illustrative purposes. Many variations of the disclosed embodiment are believed to be within the spirit of the invention. The following claims are intended to cover inventive portions of the disclosed embodiment and modifications believed to be within the spirit of the invention.

What is claimed is:

1. In a rotary blower of the backflow-type including a housing, inlet and outlet Ports having longitudinal and transverse boundaries formed by wall surfaces defined by the housing, and a chamber defined by the housing; first and second meshed lobed rotors disposed in the chamber for transferring volumes of relatively low-pressure inlet port air via spaces between adjacent, unmeshed lobes to relatively high pressure outlet port air; means for controlling the rate at which outlet port air backflows into the transfer volume; the improvement comprising:

first and second expanding orifices disposed on transversely opposite sides of the outlet port and defining the control means, said orifices defined by transverse wall extensions of the outlet port wall surfaces and traversing of the transverse wall extensions by the lobes prior to traversal of the outlet port boundaries, and said expanding orifices alternately operative at predetermined rotor speeds and pressure differential relationships to maintain a substantially constant backflow rate into each of the transfer volumes.

2. The blower of claim 1, wherein said expanding orifices are each operative to expand over a period substantially equal to 360°/2 where n equals the number of lobes per rotor.

3. The rotary blower of claim 1, wherein the wall surfaces defining the transverse boundaries of the inlet port are disposed substantially parallel to the traversing lobes.

4. The rotary blower of claim 1, wherein each rotor includes three lobes.

5. The blower of claim 1, wherein the lobes are formed with a helical twist substantially equal to the relation 360°/2n, where n equals the number of lobes per rotor.

6. The rotary blower of claim 5, wherein the lobes are formed with a substantially involute profile.

7. The rotary blower of claim 1, wherein the rotors are disposed for rotation about parallel axes.

8. The rotary blower of claim 7, further including meshed timing gears fixed to the rotors for preventing contact of the meshing lobes.

9. The rotary blower of claim 1, wherein the rotors are disposed for rotation about parallel axes and timed with respect to each other by meshed gears fixed to the rotors; each rotor including three lobes formed with a helical twist from end-to-end of substantial 60°, and said expanding orifices are each operative over rotational periods of substantially 60°.

10. The rotary blower of claim 9, wherein wall surfaces defining the transverse boundaries of the inlet port are disposed substantially parallel to the traversing lobes at the time of lobe traversing.

11. The rotary blower of claim 9, wherein the lobes are formed with a substantially involute profile.

12. The blower of claim 1, wherein the transverse wall extensions defining each expanding orifice converge as they transversely extend away from the outlet port.

13. The blower of claim 12, wherein the intersections of the outlet port wall surfaces and the transverse wall extensions defining each expanding orifice are spaced apart such that a lobe of one rotor traverses the intersection of one of the expanding orifices at substantially the same time a lobe of the other rotor traverses the convergence of the transverse wall extensions of the other expanding orifice.

14. The blower of claim 12, wherein the intersections and convergence of the wall surfaces of each expanding orifice are substantially equal to 360°/2n, where n equals the number of lobes per rotor.

15. In a rotary pump of the backflow type including a housing defining first and second parallel, overlapping cylindrical chambers having transversely spaced longitudinal axes; an inlet Port and an outlet port having longitudinal and transverse boundaries defined by housing wall surfaces, disposed on opposite sides of the housing at the plane of intersection of the chambers, and respectively communicating with relatively low and high pressure fluids; first and second rotors respectively disposed in the first and second chambers and having circumferentially spaced lobes meshing with each other, the spaces between adjacent lobes of each rotor operative when sealingly cooperating with cylindrical wall surface portions of the associated chamber to transfer volumes of the low pressure fluid to the high pressure fluid in response to the leading lobe of each transfer volume traversing the boundaries of the outlet port; the improvement comprising:

first and second expanding orifices respectively associated with the transfer volumes of the first and second rotors and alternately operative to control the backflow rate of outlet port fluid to the associated transfer volumes, said orifices defined by transverse wall extensions of the wall surfaces of opposite transverse boundaries of the outlet port and traversing of the transverse wall extensions by the lobes prior to traversal of the outlet port boundaries, said expanding orifices alternately operative at predetermined rotor speed and pressure differential relationships to maintian a substantially constant backflow rate.

16. The blower of claim 15, wherein wall surfaces defining the transverse boundaries of the inlet port are disposed substantially parallel to the traversing lobes.

17. The blower of claim 15, wherein the lobes are formed with a helical twist substantially equal to the relation 360°/2n, where n equals the number of lobes per rotor, the lobes are timed with respect to each other by meshed gears fixed to the rotors, and said expanding orifices are each alternately operative over rotational periods of substantially 60°.

18. The rotary blower of claim 17, wherein the lobes are formed with a substantially involute profile.

* * * * *